US006102137A

United States Patent [19]

Ward et al.

[11] Patent Number: 6,102,137

[45] Date of Patent: Aug. 15, 2000

[54] APPARATUS AND METHOD FOR FORMING DUCTS AND PASSAGEWAYS

[75] Inventors: Peter Ward, Northumberland, United Kingdom; James Thomson, Geneva, Switzerland

[73] Assignee: Advanced Engineering Solutions Ltd., United Kingdom

[21] Appl. No.: 09/032,669

[22] Filed: Feb. 27, 1998

[30] Foreign Application Priority Data

Feb. 28, 1997 [GB] United Kingdom ..... 9704181

[51] Int. Cl.[7] ..... E21B 7/04; E21B 47/12

[52] U.S. Cl. ..... 175/45; 175/62; 166/66.5

[58] Field of Search ..... 175/45, 40, 50, 175/61, 62, 74; 166/66.5

[56] References Cited

U.S. PATENT DOCUMENTS

| | | | |
|---|---|---|---|
| 3,529,682 | 9/1970 | Coyne et al. | 175/45 |
| 4,881,083 | 11/1989 | Chau et al. | 175/45 X |
| 4,953,638 | 9/1990 | Dunn | 175/61 |
| 5,320,180 | 6/1994 | Ruley et al. | 175/26 |
| 5,515,931 | 5/1996 | Kuckes | 175/45 |
| 5,589,775 | 12/1996 | Kuckes | 175/45 X |

*Primary Examiner*—Frank Tsay
*Attorney, Agent, or Firm*—Woodard, Emhardt, Naughton Moriarty & McNett

[57] ABSTRACT

The apparatus and method of the invention relates to the formation of ducts or passageways, referred to as ducts underground by using existing lengths of plant such as pipes, cables or wires, or a length of plant laid in predetermined position as a guidance or reference for the drill head used to form the duct or passageway as it passes through the ground. The plant is used to generate an electromagnetic field which is sensed by at least one electromagnetic field sensor mounted in the drill head, said sensor rotated to allow comparison of signals and the distance of the drill head from the plant to be calculated. Other sensors can also be provided to determine other positional characteristics of the drill head with respect to the plant. This allows the duct to be formed with the avoidance of potentially hazardous plant and/or along a path which is determined with reference to the plant. The apparatus can also be used as a guidance means without the drill to pass along existing passageways and indicate the path of the same using the same operating procedure.

30 Claims, 8 Drawing Sheets

APPARATUS AND METHOD FOR FORMING DUCTS AND PASSAGEWAYS

CROSS REFERENCE TO RELATED APPLICATION

This application claims priority to British Patent Application Serial No. 9704181.8, filed on Feb. 27, 1997, and entitled: "Apparatus and Method of Forming Ducts and Passageways", which is hereby incorporated by reference in its entirety.

FIELD OF INVENTION

The invention which is the subject of this application relates to an improvement in the provision of apparatus and a method for the installation of ducts, cables and pipes and particular in the forming of the same with respect to existing or prepositioned plant which can be in the form of cables, wires, ducts or pipes.

BACKGROUND OF THE INVENTION

The apparatus and method of the invention has several advantageous uses. One such use is to install ducts, cables or pipes (herein collectively referred to as ducts) adjacent to existing plant such as electricity, telecom or other utilities. The installers of new ducts such as this are frequently faced with the problem of increasing the capacity of the system along a particular length of the said system.

Conventionally, new plant installations were installed along the existing ducts and along which existing plant ran in groups between access manholes. At the time of laying the existing ducts, additional spare capacity was normally provided but, as the requirement for new systems and equipment has greatly increased in recent years, it is increasingly found that the spare capacity has been used up and therefore installation of new ducts is required.

SUMMARY OF THE INVENTION

As it is preferable to use the existing routes for plant in order to minimise the length of cable which is required to be installed between the manholes and in order to allow the installer to use existing rights of way under private or publicly owned property, there is a need for the provision of method and apparatus which allows the formation of the new ducts for the new plant in a controlled manner along and adjacent to the existing plant, thereby negating the need for excavation and the gaining of new rights of way.

The installation of new ducts for plant in close proximity to existing plant using trenchless techniques i.e, where the surface is not required to be dug up, is currently not practically achievable using known techniques as this requires an accuracy of drilling of the duct which is not achievable using known techniques. The known techniques do not allow control of the drill to provide sufficient accuracy to avoid damage, or the risk of damage, to either the existing ducts and plant therein and/or deviating from the required line.

The existing techniques for drilling of ducts for installation of plant typically use an incremental location and steering system which, in one embodiment, comprises a radio transmitter known as a radiosonde in the nose of the drill. The radiosonde radiates a low frequency magnetic signal which is detected at the surface by a locator and therefore the position of the drill head in the ground can be determined by sweeping the locator over the surface until the maximum signal is detected. When the maximum signal is detected then the operator has located and can then control the further passage of the drill head. The radiosonde also transmits other signals to the locator at the surface which identify the orientation or roll angle of the steering face and this information is transmitted to the drill rig by a conventional UHF radio transmitter to the drill operator who can then set the angle of the steering face accordingly. However, the measurement of the position and changes in steering can only be carried out when the drill is stationary and, in order to maintain a reasonable rate of progress for the drilling operation the location readings from the drill are typically only taken at intervals of 1 to 2 meters. This has two disadvantages, firstly that the drill is required to be stopped at relatively frequent intervals to allow the position of the same to be checked and secondly, the accuracy of drilling is limited due to the fact that the drill is able to deviate from the chosen line between incremental measurements and this is unsatisfactory when drilling in close proximity to existing plant. Additionally, the accuracy of the location process decreases with increasing depth as the strength of the signal received at the surface reduces and the accuracy of the position measurement of the drill depends on the skill of the operator in locating the signals. It is also potentially hazardous to the operator seeking to locate the drill especially if they have to cross motorways, rivers or the like. An alternative method is to use a "mat" formed of a series of cables with current passing through the same, laid on the ground in the general line of the duct to be formed. This mat generates a complex electrical field and can allow guidance of a drill head. However these cable array mats are bulky, expensive and prone to damage and have not been commercially successful.

The aim of the present invention is to provide apparatus and a method for forming a passageway, herein referred to as a duct, and guiding the apparatus forming the new duct with respect to other plant thereby ensuring that the new duct created follows the desired path.

In a first aspect of the invention there is provided apparatus for the creation of a duct on or under the surface of the ground, said apparatus comprising a length of plant which generates an electromagnetic signal along the same, to utilise the same for guidance, a drill head for movement through the ground to create the duct, said drill head including a detector means including at least one electromagnetic field sensor mounted in an offset position with respect to the centre of the drill head, to allow detection and monitoring of the electromagnetic field of the guidance plant and a means to rotate the electromagnetic field sensor about the centre of the drill head.

In one embodiment the length of plant for guidance is an existing piece of plant such as a length of cable, metallic pipe or wire laid in an existing duct under the surface, The existing piece of plant may normally generate an electromagnetic field which can be used as guidance, or alternatively, a current can be impressed along said plant to create an electromagnetic field. In an alternative embodiment, the guidance plant is a length of cable or wire which is placed on the surface and this acts as a reference for guidance of the drill head under the surface.

In one embodiment the electromagnetic field sensors used are electromagnetic coils and are hereinafter referred to as coils.

In one embodiment, the drill head includes two coils, one positioned with its longitudinal, or sensitive, axis along the longitudinal axis of the drill and the other positioned offset to the centre and with its longitudinal or sensitive axis substantially perpendicular to the longitudinal axis of the drill head.

In a further embodiment, the drill head includes three coils mounted thereon, one coil positioned with its longitudinal axis along the longitudinal axis of the drill head, and the other two positioned with their longitudinal axes substantially perpendicular to the longitudinal axis of the drill head and respectively offset on opposing sides of the centre of the drill head.

In whichever embodiment, it is preferred that any coil which is provided offset to the centre of the drill head lie on or adjacent to the outer surface of the drill.

In use, the coil positioned along the longitudinal axis of the drill head detects changes in the angle of the drill head relative to the plane formed between the drill and the guidance plant and the coil offset from the drill head centre is rotated to detect changes in the position of the drill head relative to the guidance plant, i.e. towards or away from the plant.

In one embodiment if the detection means indicates that the drill head is moving to within a predetermined distance of plant with an electromagnetic field, an alarm is sounded to the operator and the drill head movement is stopped. It is envisaged that this arrangement is of particular use when the drill head is approaching existing plant which generates an electromagnetic field and which lies adjacent to the path of the drill head and so the path of the duct forming apparatus can be changed to avoid the plant and prevent damage to the same.

Typically there is provided apparatus for forming a duct wherein the electromagnetic field sensor is positioned on or adjacent to the outer surface of the drill head, and detects the field gradient at that position, and thus the distance of the drill head from the guidance plant, using the equation $D2=V2n.S/(V2p-V2n)$ where V2p is a first field reading from a first position of the sensor, V2n is a second field reading from a second, rotated, position of the sensor and D2 is the distance between the centre of the guidance plant and the outer surface of the drill head.

In a further embodiment of the invention the drill head is provided with a sensor to detect the rotational angle of the drill head relative to a linear plane, typically the vertical plane. Typically a conventional roll angle sensor is provided in the drill head.

Typically the signal impressed into the guidance plant is an alternating electric current and, if access can be gained to the guidance plant then the current can be injected by direct connection of a current generator to the plant or, alternatively, by inducing a current in the cable using a torroidal transformer placed over the plant. If no access can be gained to the plant then the current can be induced using a remote transmitter placed on the surface. Furthermore it is known that some existing plant already generates an electromagnetic field and if this is the case then the plant can be detected without impression of electrical current. This also ensures that this plant can be detected even if it is not being used to continually guide the drill head but is an obstacle to the path of the drill head.

The alternating electric current of a single frequency or plurality of multiple frequencies provided to the guidance plant can be of any value as required but typically in the range of 0.1 Hz to over 100 KHz and the current introduced into the plant generates an alternating magnetic field which radiates from the plant.

Typically the drill head includes an angled face which acts as a steering face of the drill.

Preferably the detector means on the drill head includes at least two, solenoidal, coils and they are connected to suitable electronic filters and amplifiers to detect the magnetic field and processing means and software to allow the processing and interpretation of the signals to provide the data to the operator for continued guidance of the drill head.

In a further aspect of the invention there is provided apparatus for measuring and guiding the position of an article, said article including a detector means including at least one electromagnetic field sensor mounted in an offset position with respect to the centre of the article, to allow detection and monitoring of an electromagnetic field, and a means to rotate the electromagnetic field sensor about the centre of the article.

Typically the apparatus can include any of the features as herein described with regard to the apparatus for forming the ducts or passageways such as further electromagnetic field sensors and/or roll angle sensors. In one embodiment the apparatus is provided not on a drill head for forming the duct or passageway but on an article for movement along a previously formed existing duct or passageway and to allow the position of the duct or passageway to be determined with reference to adjacent plant generating an electromagnetic field and operating the guidance apparatus as previously described.

In a further aspect of the invention there is provided a method for creating a duct, said method comprising the steps of positioning a drill head including at least a first electromagnetic field sensor mounted therein for indicating the distance of the drill head from other plant by detecting the electromagnetic field generated from said other plant, advancing the drill to form the duct and rotating the electromagnetic field sensor to generate a series of signals indicative of the electromagnetic field strength to allow the positioning of the drill head to be determined with reference to the said other plant.

Typically the sensor is rotated along with the drill head during formation of the duct, either continuously or, alternatively the sensor is rotated at intervals through at least one half revolution.

In one embodiment the said other plant is existing plant which is already in position and with respect to which the path of the drill head is determined. In another embodiment the said other plant is existing plant which represent an obstacle to the path of the duct and the presence and position of which is required to be detected to allow the path of the drill head to be controlled to avoid the same. In a further embodiment the said other plant is a length of cable or wire or other material laid on the surface and which acts as a reference guide for the drill head.

Typically the electromagnetic field sensors used in the method are electromagnetic coils and are hereinafter referred to as coils.

In a first embodiment the coil is provided with its longitudinal or sensitive axis lying substantially perpendicular to the longitudinal axis, of the drill head.

In one embodiment the drill is moved to a start position with the longitudinal axis of the drill parallel to the longitudinal axis of the guidance plant and the sensitive or longitudinal axis of one coil along the longitudinal axis of the drill head is in this arrangement perpendicular to the flux lines which radiate from the guidance plant magnetic field. In this orientation the output signal from the coil is a minimum or null.

The output signals received from the offset and rotated coil is dependent on the orientation of the longitudinal axis of the drill relative to the cable and also on the rotational orientation of the drill. The maximum output from the coil is obtained when the drill head is rotated so that the sensitive or longitudinal axis of the coil is perpendicular to the plane of the guidance plant and the drill. The minimum output signal from the coil is obtained when the sensitive axis of the coil is parallel to the plane of the drill and the guidance cable. As the drill is rotated further the output from the coil produces a maximum negative output and then a zero output following a sinusoidal pattern.

Thus, the apparatus and method of the invention can be used to advantage in several ways such as for forming ducts for the installation of new plant in groups between manholes in order to minimise the usage of cable and to use existing rights of way. Indeed the plant can be dragged along by the drill apparatus as the duct is formed. If the new plant is laid within a specified and controlled distance from the existing plant then it should not be necessary to negotiate new rights of way A further use is for the automatic guidance of the drill parallel to and below a single cable laid on the surface. The cable is laid on the ground surface along the proposed route of the drill and the drill head can be directed using the sensor system described herein.

A further use is for the installation of new plant in close proximity to high value plant such as fibre optic data cables or hazardous electrical cables or pipes containing hazardous fluids. The apparatus provides a means of drilling in close proximity and guiding the drill to prevent the drill damaging the existing cables. In can therefore be referred to as a cable avoidance system. An electromagnetic signal is injected into the cable to be protected or the cable may already generate an electromagnetic field and the apparatus for guiding the drill is able to continuously measure the separation of the drill from the cable and also provide information on the orientation of the drill relative to the cable. The position of the drill relative to the cable can therefore be continuously monitored and the drill steered to maintain safe distance.

Specific embodiments of the invention will now be described with reference to the accompanying drawings wherein:

DETAILED DESCRIPTION OF THE INVENTION

Figure 1:
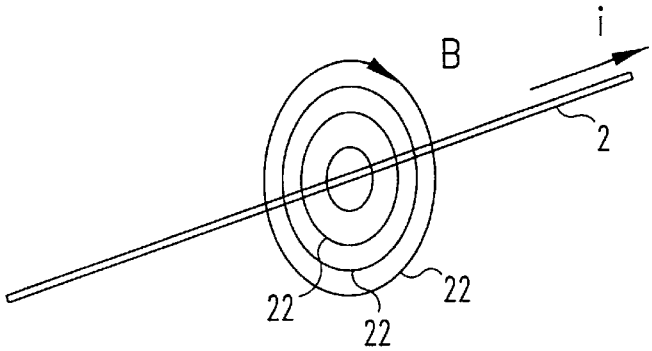
FIG. 1 illustrates a guidance plant in the form of a cable and associated magnetic field.

Referring firstly to FIG. 1 there is illustrated a guidance plant 2 and, in this embodiment, the guidance plant is a cable which has previously been laid in existing ducts in the ground. An alternating electric current is injected into the cable 2 and the current is flowing along the cable 2 generates an alternating magnetic field indicated by the letter B which radiates outwardly from the cable and along the length thereof.

Thus, this guidance cable is activated to act as a guide for reference for a drill which is to be used to form a duct running parallel to the said guidance cable 2 at an offset distance therefrom.

Figure 2:
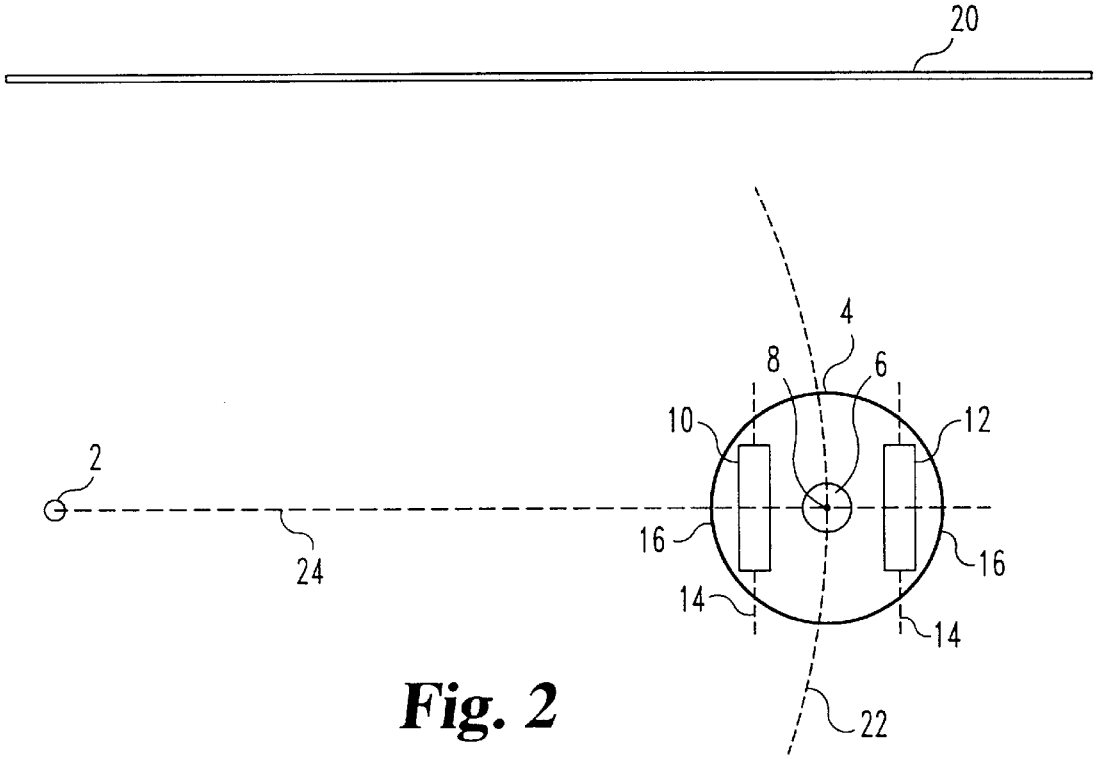
FIG. 2 illustrates a first embodiment of the invention showing the drill head in conjunction with the guidance plant.

In a first, but not the preferred, embodiment, the drill 4, which is shown in end elevation in FIG. 2, is provided with three electromagnetic field sensors in the form of electromagnetic coils 6 mounted with its sensitive or longitudinal axis 8 along the longitudinal axis of the drill centre and coils 10 and 12 which have their sensitive longitudinal axis 14 perpendicular to and offset from the sensitive axis of the first coil 6. The coils 10 and 12 are mounted adjacent the external side 16 of the drill at diametrically opposed positions.

To set the drill in the required starting position, the same is positioned at the required offset distance from the guidance cable 2 and at the required depth from the surface of the ground 20.

When the longitudinal axis of the drill 4 is in this parallel position with the guidance cable 2, the sensitive axis 8 of the coil 6 is perpendicular to the flux lines 22 of the magnetic field B as shown in FIG. 1. In this position the output signal received from the coil 6 is at its minimum or a null.

Figure 3:
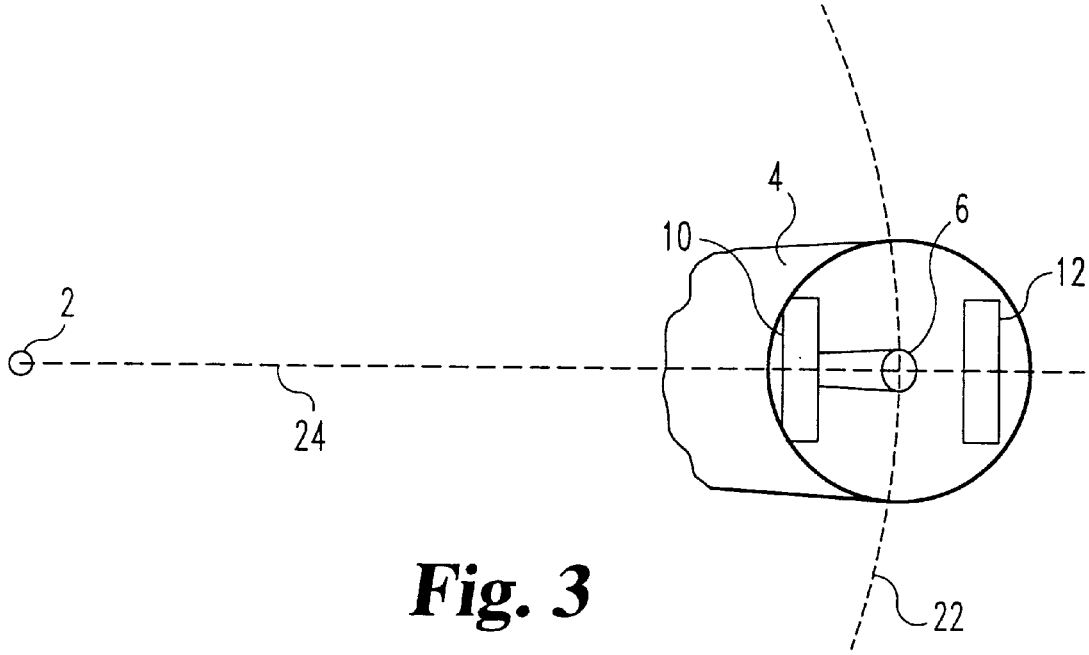
FIG. 3 illustrates the drill head of FIG. 2 in a moved position.
Figure 4:
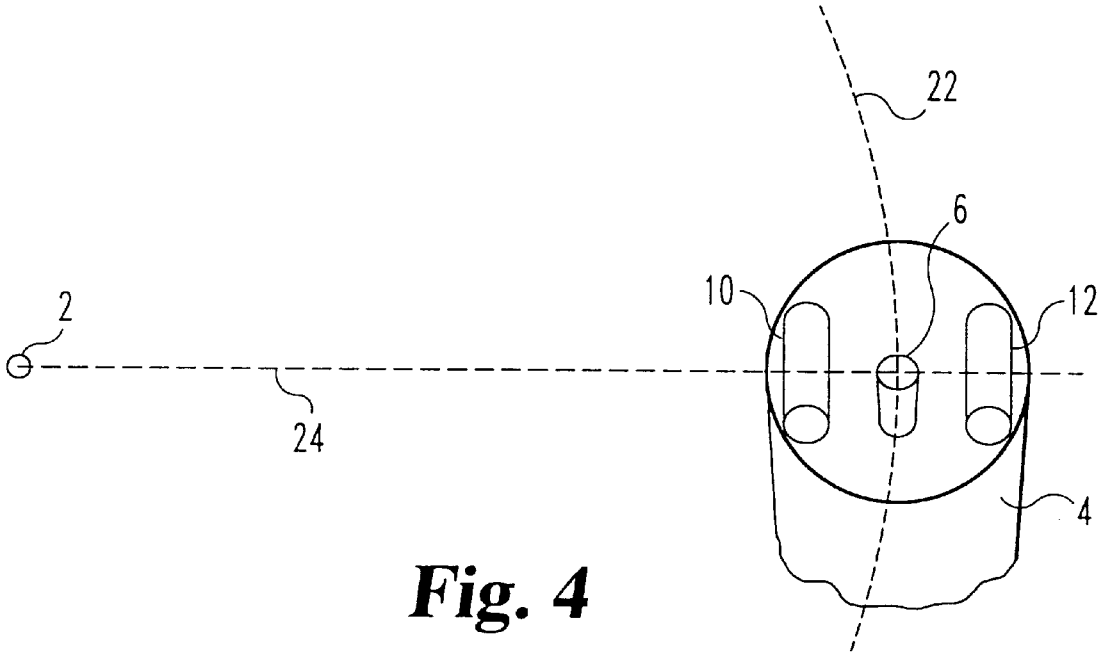
FIG. 4 illustrates the drill head of FIG. 2 in a further position.

If the drill changes direction but in the plane 24 defined between the guidance cable 2 and the centre of the drill 4, such as shown in FIG. 3, then the sensitive axis 8 of the coil 6 remains in its perpendicular position to the flux lines 22 and thus the output signal received from the coil remains in its minimum or a null value. However, if the drill changes direction and if this change of direction moves the drill out of the plane 24 such that the length of the drill no longer lies in the plane 24 in end elevation, such movement shown in FIG. 4, then the coil 6 intersects a flux line 22 of the magnetic field and the output signal from the coil 6 will increase, Thus it will be clear that the output signal from the coil 6 only changes in response to changes in the direction of the drill which moves the longitudinal axis of the drill out of the plane 24 as illustrated in FIG. 4.

The direction and extent of movement of the drill outwith the plane 24 is detected by comparing the output signal received from the coil 6 to the electrical current value applied to the guidance cable 2. As both the signal received and the electric current are time varying sinusoids, the time relationship between the two, i.e. the phase difference, can be analysed and this allows the direction and plane of the sensitive or longitudinal axis 8 of the coil 6 in the magnetic field B to be determined.

Figure 5:
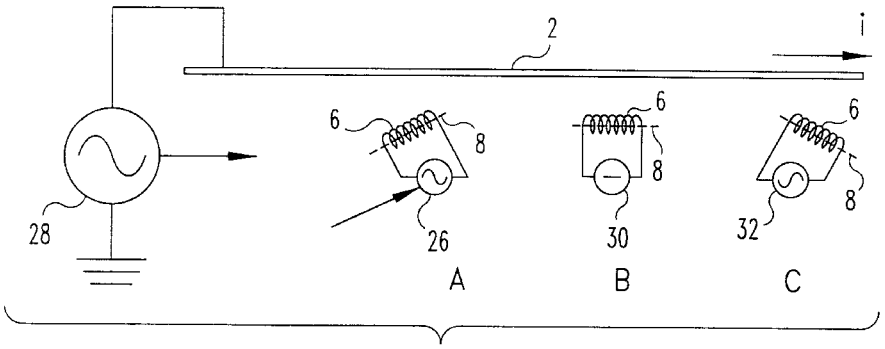
FIG. 5 illustrates schematically the positions and signals generated by the first coil relative to the guidance cable.

FIG. 5 illustrates in diagrammatic form the manner in which the coil 6 position relative to the guidance cable 2 can have an effect on the output signal received. In position A the output from the coil is a sinusoid and, when compared to the wave form of the electric current supplied to the guidance cable 2, it can be seen that the output 26 from coil 6 is in phase with the wave form 28 of the electric current supplied to the guidance cable 2. In position B the output 30 from coil 6 is zero as no flux lines are being cut as the drill lies in the same plane in this position. In position C the coil 6 has effectively reversed its orientation such that the sensitive axis 8 and hence drill 4 is now pointing away from the guidance cable 2 and thus the output 32 from coil 6 is a sinusoid form which is 180 degrees out of phase with the signal 28. Thus, the position of the sensitive axis 8 of the coil 6 and hence the longitudinal axis of the drill 4 can be determined by comparison of the output signal 26, 30, 32, or any other output signal received, with the wave form and signal 28 of the guidance cable 2.

The orientation of the longitudinal axis of the drill 4 relative to the guidance cable 2 and also the rotational orientation of the drill 4 relative to the plane containing the guidance cable and drill can be determined by analysing output signals received of the coils 10 and 12 of the drill. The maximum output from the coils 10 and 12 is obtained when the drill is positioned such that the sensitive axis 14 as shown in FIG. 2 of the coils 10 and 12 is perpendicular to the plane 24 between the drill and guidance cable as shown in FIG. 2 and as illustrated in position A of FIG. 6. The minimum output from the coils 10 and 12 is obtained when the sensitive axis 14 of the same are parallel to the plane 24 as illustrated in position B of FIG. 6 and, if the drill is rotated further, then a maximum negative output signal is received as indicated in position C and a further zero output signal is received at the position shown D.

It should be appreciated that a preferred embodiment is to only use one of the coils 10, 12, say coil 10, as this can be rotated to provide the required data.

Figure 6:
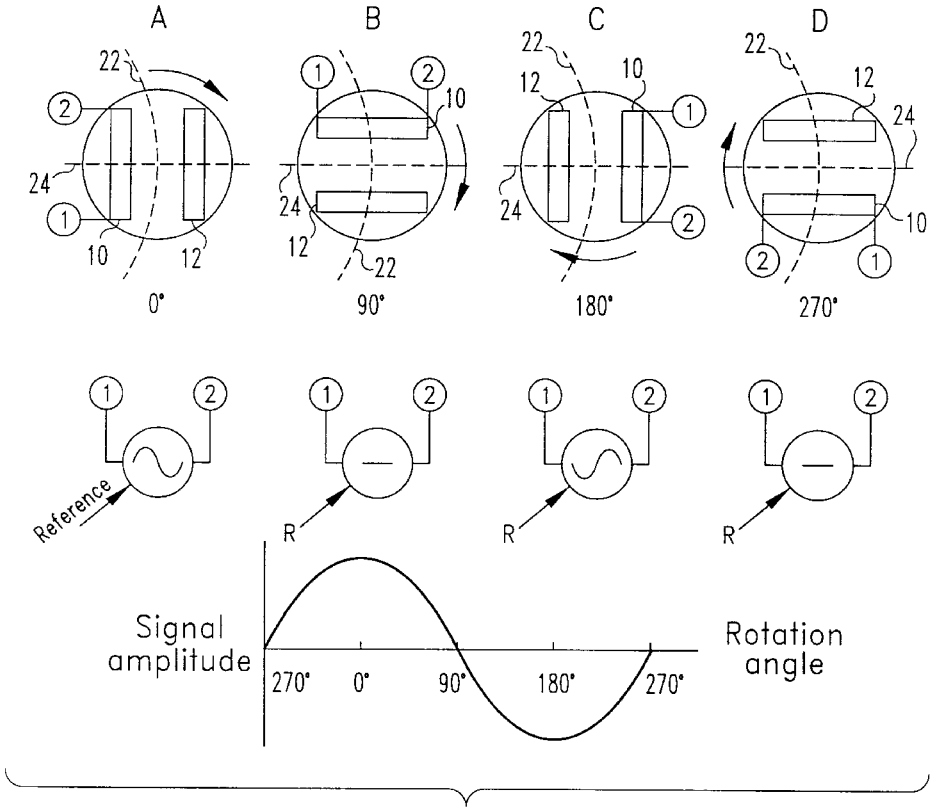
FIG. 6 illustrates the output signals received from the second and third coils of the drill head of FIG. 2.
Figure 7:
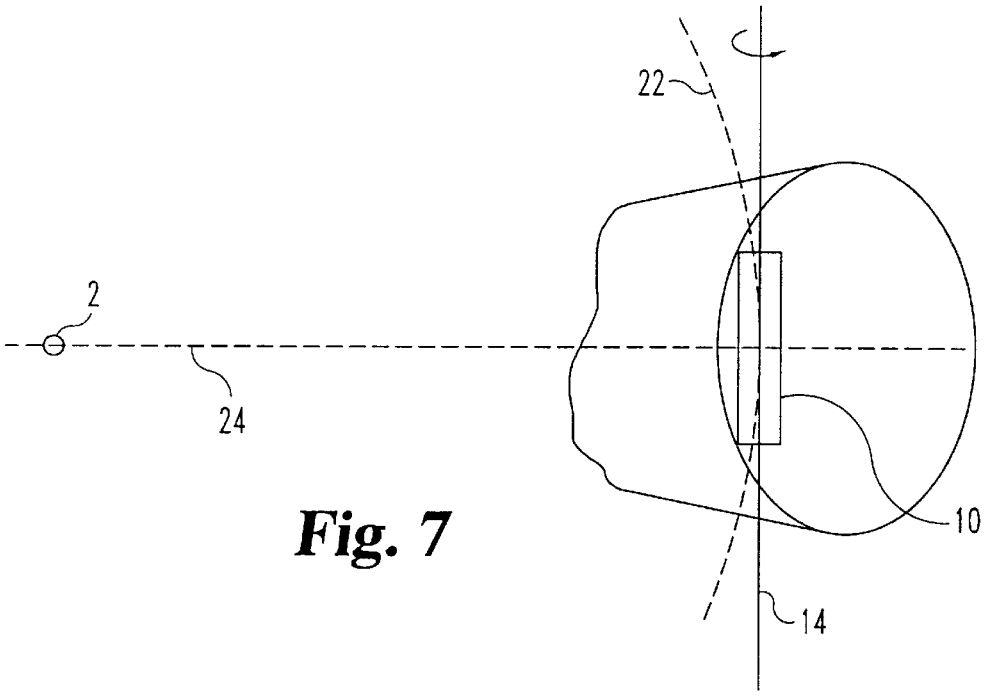
FIG. 7 illustrates the position of a second coil relative to the guidance cable.
Figure 8:
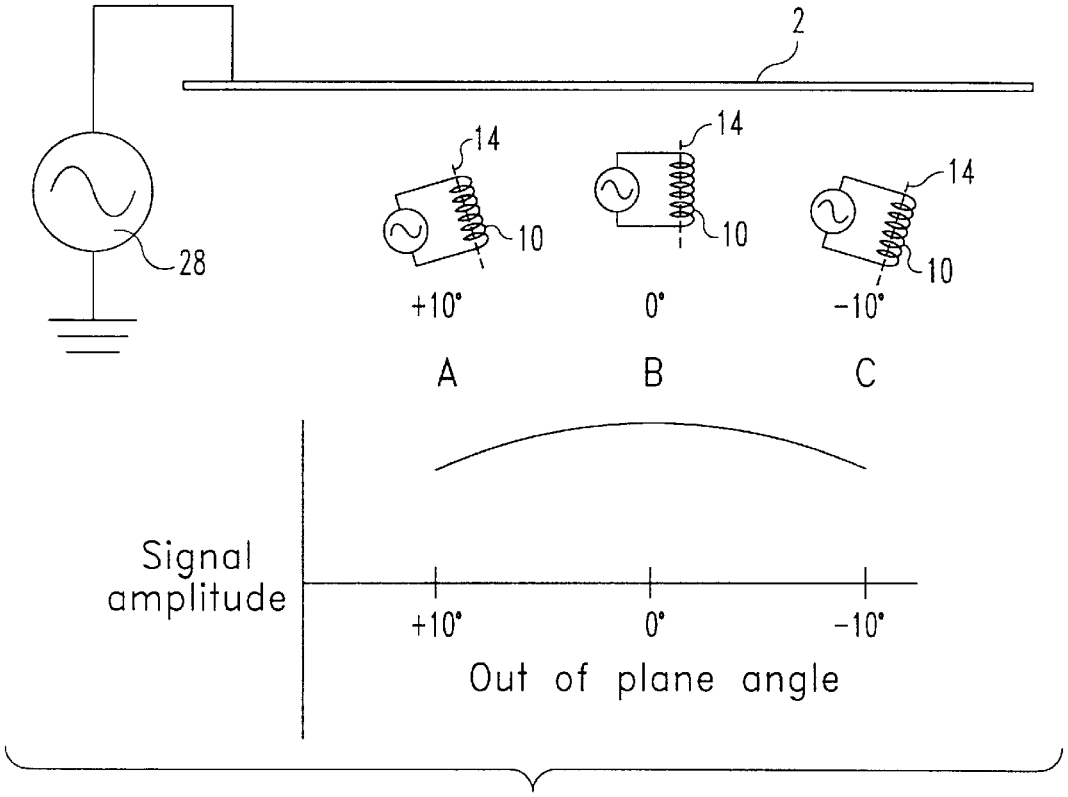
FIG. 8 illustrates in schematic form various positions and signals generated by the second and/or third coils relative to the guidance plant.

When the drill is in a rotational position which gives a maximum output as indicated at positions A and C of FIG. 6, changes in direction of the longitudinal axis of the drill 4 in the plane 24 as indicated in FIG. 7 will produce no change in the output from the coil 10 as the drill is rotating. However, changes in direction of the longitudinal axis of the drill 4 out of the plane 24 produces a decrease in output signal received as indicated in FIG. 8, with FIGS. 7 and 8 illustrating the coil 10 only for illustrative purposes. FIG. 8 illustrates the difference in the signal amplitude which occurs when, for example, sensitive axis 14 of coil 10 deviates by 10 degrees from the perpendicular position shown at the position B of FIG. 7.

Figure 9:
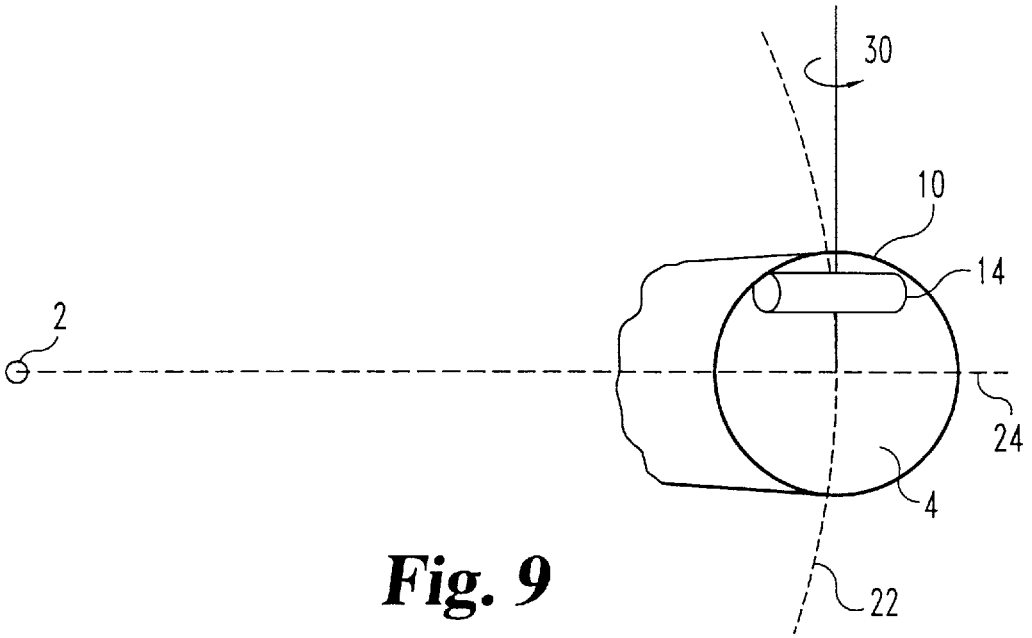
FIG. 9 illustrates a further position of the second coil relative to the guidance plant.

FIG. 9 illustrates the drill 4 in a position where the direction of the same has changed but in the same plane as plane 24 such that the reading from the coil 6 will not alter and, as the rotation is about axis 30, which is perpendicular to the axis 14 of the coil 10, the coil 10 will not be sensitive to orientation changes in or out of the plane.

Figure 10:
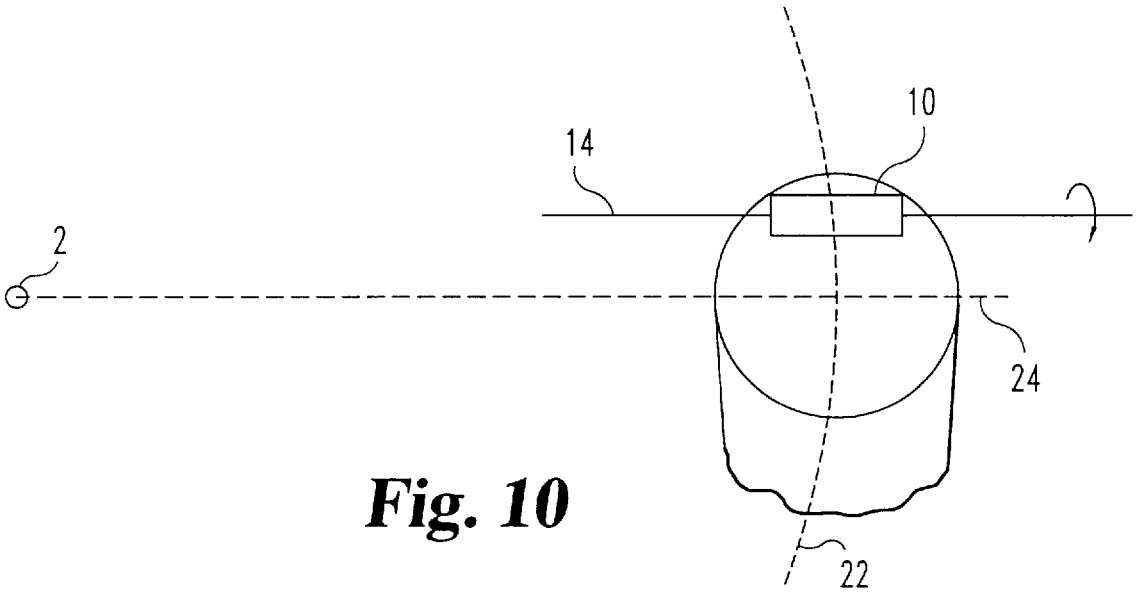
FIG. 10 illustrates a further position of the coil relative to the guidance plant.

In FIG. 10, the coil 10 is rotated about its sensitive axis 14 but with the coil 10 in the parallel plane to the plane 24 and thus, the output signal for the coil 10 is zero with reference to position B of FIG. 6 and as the position of the same does not change relative to the plane 24 no change in signal output will occur but the actual change of the drill 4 upon rotation will be sensed by the change of signal received from the coil 6 with reference to FIG. 4, as the drill moves out of the plane 24.

Figure 11:
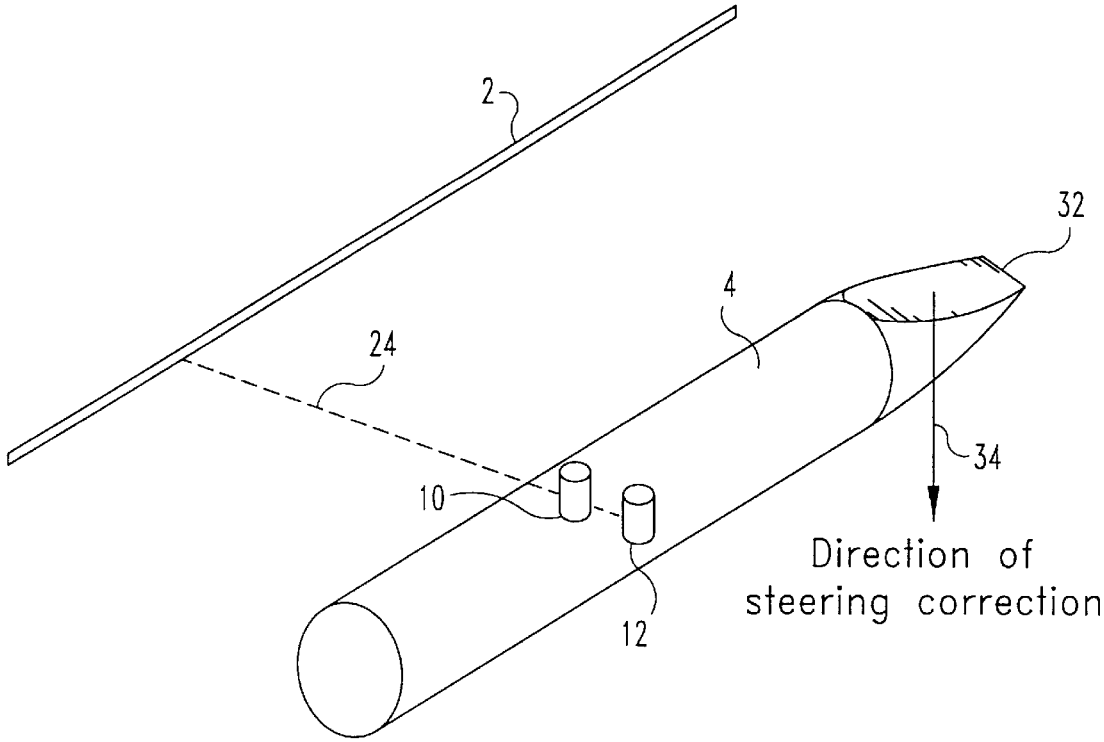
FIG. 11 illustrates the drill head in a position relative to the guidance plant in a perspective view.

Thus, if the coil 10 is positioned in the drill 4 with the sensitive axis 14 aligned parallel to the steering face 32 of the drill 4 as shown in FIG. 11, then by rotating the drill 4 and observing output from the coil 10 when rotated until they reach a maximum value, it is possible to orientate the coil 10 and hence the steering face 32 to lie with their planes and plane movement 34 respectively, perpendicular to the plane 24. The drill is now pushed forward without rotation and steering corrections can be made to change the direction of the drill perpendicular to the plane 24. Thus if the output from coil 6 indicates a change in output from the minimum i.e. a deviation out of the plane 24 then a steering correction can be made by rotating the drill until a maximum is obtained from the coils 10 and 12 and, if the rotation is then stopped at this position the drill can then be pushed forwards to direct the drill 4 back towards the plane 24.

The positioning is dependent upon the starting position of the drill 4 relative to the guidance cable 2 such that it can be above, below, to the side or any position offset from the guidance cable throughout 360 degrees thereof.

Figure 12A:
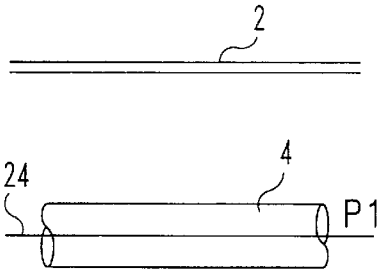
FIGS. 12A to F illustrate in schematic form various positions of the drill relative to the guidance plant.
Figure 12B:
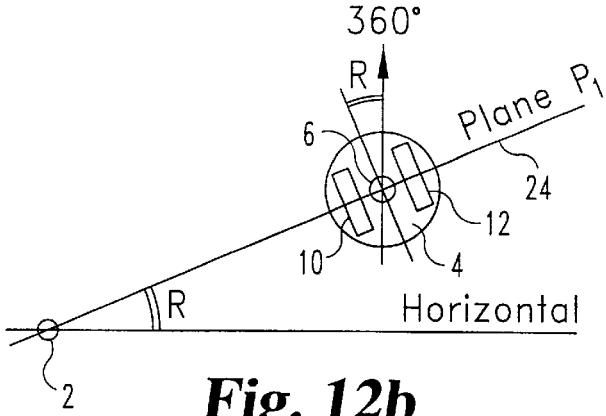
Figure 12C:
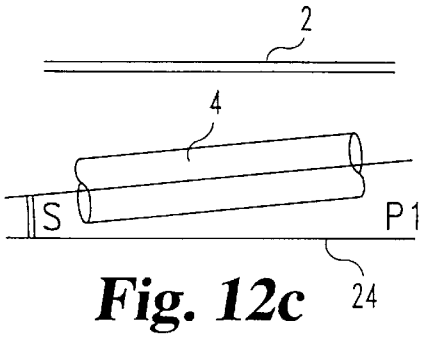
Figure 12D:
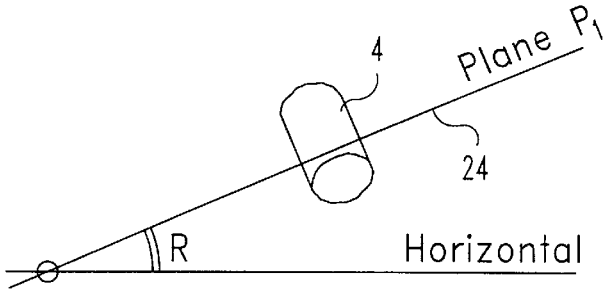
Figure 12E:
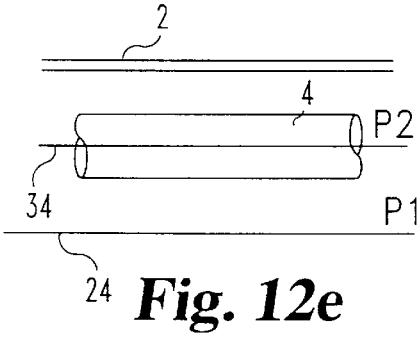

The plane 24 as shown in FIG. 12*a* and 12*b* can be at any rotational angle R to the horizontal plane and coil 6 is provided to measure deviations from this initial orientation. However, the drill 4 can be subjected to perturbations due to changes in ground conditions as the drill passes therealong and these perturbations can cause the drill 4 to deviate from the plane 24 by an angle S as indicated in FIGS. 12*c* and 12*d*. With the output signal received from coil 6, and comparison of this with the input signal 28 to the guidance cable 2, the deviation between the signals can be detected and, in conjunction with the output signals received from the coil 10, the drill 4 can then be rotated until the steering face 32 is pointed in the correct direction such that when the drill is moved in that direction, the deviation will be corrected and the angle S of deviation will be reduced to zero as shown in FIG. 12*e* wherein the drill 4 now lies in a plane 34 which is parallel to plane 24 and guidance cable 2.

Figure 12F:
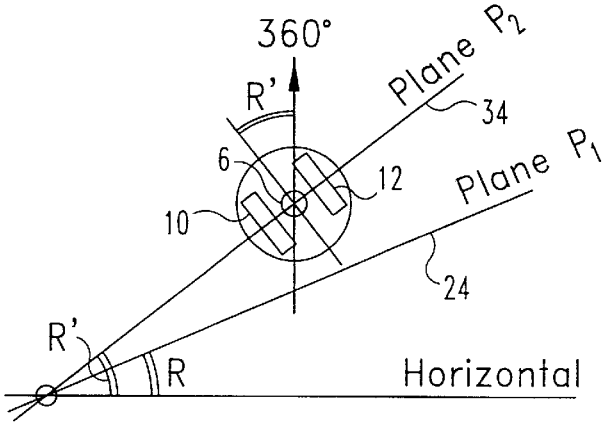

The steering mechanism thus described can bring the drill 4 back into line with the guidance cable 2 but it may be at a different rotational angle R' as indicated in FIG. 12*f* in comparison to the rotational angle R in FIG. 12*b*. To return the drill to the original rotational angle R, a roll angle sensor can be provided on the drill which measures the roll angle of the drill relative to the vertical plane. Information from one of these sensors, when combined with the information from coils 10 can be used to return the drill to the original rotational angle R in the following manner, whereby if the drill is rotated whilst in the original position, the maximum output from coil 10 is obtained when the roll angle of the drill is at 360-R degrees such as that shown in FIG. 12*b*. If the drill is rotated whilst in the second position as shown in FIG. 12*f*, the maximum output from the coil 10 is obtained when the roll angle of the drill is at 360-R' degrees and thus the roll angle at which the maximum value occurs indicates the rotational position of the drill 4 relative to the guidance cable 2. The steering system can then be used to return the drill back to the first position as shown in FIG. 12*a* by stopping rotation of the drill when the maximum value is reached and pushing forward the drill to bring the same into the required plane.

In addition to deviations of the drill out of the plane 24, the system is capable of measuring and correcting for deviations in the position of the drill in the plane 24. Because of the shape of the magnetic field B around the guidance cable 2 it is not possible to use the coil 6 to measure angular deviations of the drill 4 in the plane 24 but, by using the coils 10,12 it is possible to measure the distance from the drill 4 to guidance cable 2 by, in one embodiment rotating the drill to the roll angle where a maximum positive output signal is received from the coil 10 and a maximum negative output signal is received from coil 12 comparing the signals to generate a distance value from the guidance plant and then rotating the drill until a maximum negative output signal is received from coil 10 and maximum positive output signal is received from coil 12 and comparing and so on as the drill head progresses. The output signals from the coils 10,12 are proportional to the current in the guidance cable and inversely proportional to the distance from the cable, i.e.

$$V2=K.i/D2 \text{ or } K.i=V2.D2$$

$$V3-K.i/D3 \text{ or } K.i=V3.D3$$

$$\text{therefore } V2\ D2-V3D3$$

$$\text{or } D2=V3.D3/V2$$

$$\text{but } D3=D2+S$$

$$\text{therefore } D2=V3/V2.(D2+S)$$

$$D2=V3/D2/V2+V3.S/V2$$

$$D2(1-V3/V2)=V3/S/V2$$

$$D2=V3.S/V2.1/(1-V3/V2)$$

$$D2=V3.S/(V2-V3)$$

Where i=current

D2=distance of coil 10,12 closest to guidance plant

D3=distance of coil 10,12 furthest from guidance plant

V2=reading from coil 10,12 closest to guidance plant

V3=reading from coil 10,12 furthest from guidance plant

S=distance between coils 10,12 and therefore a deviation in the drill 4 which results in D2 reducing can be corrected by rotating the drill until the output from coil 10 is a minimum and the face 32 of the drill is pointing towards the guidance cable 2. The rotation is then stopped and the drill 4 is pushed forward in the required direction for a short distance and then rotated again to obtain an estimate of the new distance of the drill from the cable 2.

Figure 13:
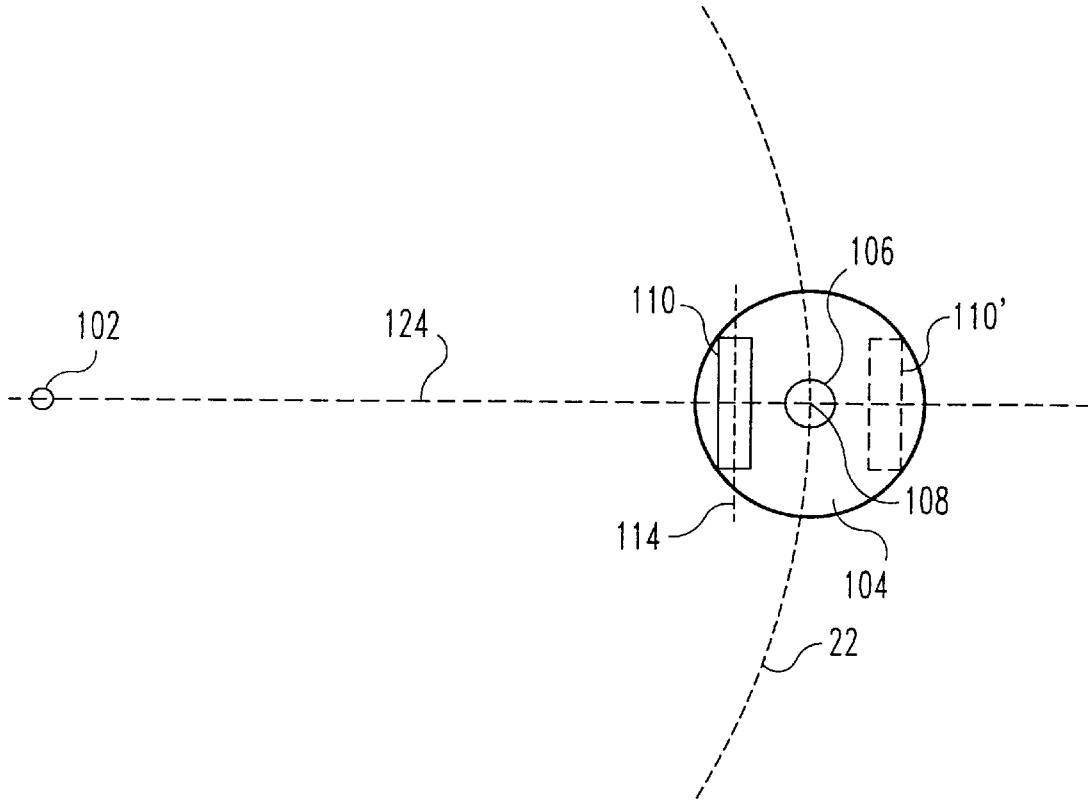
FIG. 13 illustrates a second embodiment of the drill head of the invention having a first and second coil.

An alternative and preferred arrangement of electromagnetic field sensors or coils is shown in FIG. 13, where a coil 106 is provided on drill 104 wherein the coil 106 is provided with its sensitive axis 108 along the longitudinal axis of the drill 104 which lies on a plane 124 defined between a guidance cable 102 and the centre of the drill, in end elevation. A coil 110 is positioned offset from the centre of the drill as shown and in this case on the outer surface of the drill with its sensitive axis 114 perpendicular to the longitudinal axis of the drill head. Coil 106 is used as described before with reference to coil 6 to measure the deviation of the drill 4 out of the plane 124 and coil 110 is used to measure the relative and rotational position of the drill head 104 with respect to the guidance cable 102. The distance of the drill head 104 from the cable 102 is measured using only coil 110 rather than in the previous embodiment where two coils were used. This is achieved by rotating the position of the coil 110, typically by rotating the drill head, and measuring the difference between the output signals from coil 110. When coil 110 is on the side of the drill 104 nearest to cable 102 as shown, the coil is positioned so that output from the coil will have a maximum positive value V2p and, when the coil 110 is on the side of the drill away from the cable as shown in broken lines 110', it is positioned so that the output has a maximum negative value V2n. As there is a greater distance between the coil 110 when in the position 110' on the drill 104 from the guide cable 102, the value for V2n is less than V2p and thus, the distance D2 of the drill 104 from the cable 102 is given by the expression:

$$D2=V2n.S/(V2p-V2n)$$

This embodiment has the advantage that it is not necessary for the two coils 10,12 to be used and the same to be matched and calibrated as is the case with the first embodiment wherein matching and calibration is necessary to measure the small differences across the diameter of the drill and the changes in coil parameters which can occur due to temperature and vibration. A single coil thus reduces the work needed to set the same up for use and the possible errors which can occur due to temperature and vibration are reduced. Furthermore the space requirements for use of two coils as opposed to three coils and the associated control equipment is significantly less.

The coils located in the drill are used to detect the magnetic field radiated from the guidance cable. The coils used are solenoidal coils and by the selection of the coil orientations and positions it is possible to measure the distance of the drill from the guidance plant and the orientation of the drill relative to the longitudinal axis of the guidance plant and by the use of conventional rotational angle sensors to measure the roll angle of the drill head relative to the vertical plane, in combination with the coils, it is possible to measure the position in the ground of the drill such that the duct formed thereby can be predicted and controlled to be substantially parallel and offset from the guidance cable and thus, a non-intrusive or trenchless duct forming process is provided by the present invention.

In order to install clusters of ducts for cables, it is suggested that the drill used needs to produce a bore at a nominal separation distance of for example 300 mm from the existing plant with a maximum deviation of plus or minus 100 mm in the bore. The accuracy required is achieved by using the location system described herein which continuously detects the position of the existing guidance cable using the detector in the head of the drill and provides the information for either manual or automatic steering adjustment.

Information from the detector means in the form of output signals are processed directly in the drill chuck to control a steering mechanism in the drill or the information can be passed to the drill operator at the surface where it can be displayed for manual control or to a microprocessor for a computer for automatic control of the drill and in each case, the output signal received from the detector means can then be compared to the input signal along the guidance cable, and so the control of movement of the drill can be achieved.

What is claimed is:

1. Apparatus for forming a duct or passageway on or under the surface of the ground, said apparatus comprising, a single length of plant generating, or which can be induced to generate, a simple co-axial electromagnetic field along the same, to utilize the same for guidance, a drill head for movement through the ground to create the duct, said drill head including a longitudinal axis, a centre, and a detector means including at least one electromagnetic field sensor mounted in an offset position with respect to the centre of the drill head, to allow detection and monitoring of the electromagnetic field of the guidance plant and a means to rotate the electromagnetic field sensor about the centre of the drill head.

2. Apparatus for forming a duct or passageway according to claim 1 wherein the length of plant is an existing underground cable, metallic pipe or wire.

3. Apparatus for forming a duct or passageway according to claim 1 wherein the length of plant is a length of cable or wire or other length of material which is placed on the surface in the desired location and acts as a reference for the guidance of the drill head.

4. Apparatus for forming a duct or passageway according to claim 1, wherein the electromagnetic field sensor is continuously rotated during operation of the apparatus.

5. Apparatus for forming a duct or passageway according to claim 1 wherein the electromagnetic field sensor is rotated at intervals through at least one half revolution.

6. Apparatus for forming a duct or passageway according to claim 1 wherein the drill head includes a first electromagnetic field sensor having a first longitudinal or sensitive axis positioned substantially perpendicular to the longitudinal axis of the drill head and a second electromagnetic field sensor having a second longitudinal or sensitive axis positioned substantially parallel with the longitudinal axis of the drill head.

7. Apparatus for forming a duct or passageway according to claim 6 wherein the second longitudinal or sensitive axis of the second electromagnetic field sensor parallel with the longitudinal axis of the drill head lies along the longitudinal axis of the drill head.

8. Apparatus for forming a duct or passageway according to claim 1 wherein the drill head includes three electromagnetic field sensors, one positioned with its longitudinal axis parallel with the longitudinal axis of the drill head, and the other two sensors respectively offset on opposing sides of the centre of the drill head with their longitudinal axes positioned substantially perpendicular to the longitudinal axis of the drill head.

9. Apparatus forming a duct or passageway according of claim 1 wherein the electromagnetic field sensor generates signals used to detect the gradient of the electromagnetic field and thus the distance of the drill head from the plant using the equation $D2=V2n\cdot S/(V2p-V2n)$ where V2p is a first field reading from a first position of the sensor, V2n is a second field reading from a second, rotated position of the sensor, S is the distance between the first position of the sensor and the second, rotated position of the sensor and D2 is the distance between the centre of the guidance plant and the outer surface of the drill head.

10. Apparatus for forming a duct or passageway according to claim 1 wherein a further electromagnetic field sensor is positioned to detect changes in the angle of the drill head relative to a first plane formed between the centre of the drill head and the guidance plant.

11. Apparatus for forming a duct or passageway according to claim 1 wherein the drill head is provided with a sensor to detect a signal corresponding to a rotational angle of the drill head relative to a first plane formed between the centre of the drill head and the guidance plant.

12. Apparatus for forming a duct or passageway according to claim 11 wherein the guidance plant lies in a vertical plane and a roll angle sensor is provided in the drill head and detects a signal corresponding to a rotational angle of the drill head relative to said vertical plane.

13. Apparatus for forming a duct or passageway according to claim 11 wherein the drill head is positioned a distance D2 from the outer surface of the guidance plant and the rotational angle and the value D2 are interpreted to provide a polar co-ordinate angle for the position of the drill relative to the guidance plant.

14. Apparatus for forming a duct or passageway according to claim 1 wherein a signal is impressed into the guidance plant to induce the generation of an electromagnetic field and the signal is an alternating electric current injected by any of direct connection of a current supply generated to the plant; by inducing a current in the plant using a torroidal transformer placed over the plant; or by remote induction transmitter placed on the surface.

15. Apparatus for forming a duct or passageway according to claim 14 wherein the alternating electric current of a single frequency or plurality of multiple frequencies provided to the guidance plant is in the range of 0.1 hertz to 100 kilohertz to generate a magnetic field which radiates from the plant.

16. Apparatus for forming a duct or passageway according to claim 1 wherein the drill head includes an angled face to act as a steering face.

17. Apparatus for forming a duct or passageway according to claim 1 wherein the electromagnetic field sensor used is an electromagnetic coil.

18. Apparatus according to claim 17 wherein the article is moved along an existing passageway or duct and allows the path of the duct to be determined with respect to an adjacent plant from which an electromagnetic field is generated.

19. Apparatus for measuring and guiding the position of an article, said article including a detector means including at least one electromagnetic field sensor mounted in an offset position with respect to the centre of the article, to allow detection and monitoring of a simple co-axial electromagnetic field, and a means to rotate the electromagnetic field sensor about the centre of the article.

20. Apparatus according to claim 19 wherein the article includes further electromagnetic field sensors or roll angle sensors or both.

21. A method of forming a duct or passageway, said method comprising the steps of:

positioning a drill head, said drill head including at least a first electromagnetic field sensor mounted therein for indicating the distance of the drill head from a single guidance plant by detecting the simple co-axial electromagnetic field generated from said guidance plant;

advancing the drill to form the duct or passageway; and rotating the electromagnetic field sensor to generate a series of signals indicative of the electromagnetic field strength to allow the positioning of the drill head to be determined with reference to the said single guidance plant.

22. A method according to claim 21 wherein the said first electromagnetic field sensor is positioned offset from the centre of the drill head and defines a longitudinal or sensitive axis substantially perpendicular to the longitudinal axis of the drill head.

23. A method according to claim 21 wherein the drill head is moved to a start position with the longitudinal axis of the drill head parallel to the longitudinal axis of the guidance plant and wherein said first electromagnetic field sensor defines a sensitive or longitudinal axis positioned substantially parallel to the longitudinal axis of the drill head, and perpendicular to the flux lines which radiate from the guidance plant magnetic field.

24. A method according to claim 23 wherein the orientation of the output signal from the said sensor is minimum or null.

25. A method according to claim 21 wherein the output signal received from the electromagnetic field sensor is dependent on the orientation of the longitudinal axis of the drill head relative to the guidance plant and also on the rotational orientation of the drill head.

26. A method according to claim 25 wherein the sensor is rotated along with the drill head during formation of the duct.

27. A method according to claim 25 wherein the sensor is rotated at intervals through at least one half revolution.

28. A method according to claim 21 wherein as the drill head is moved, signals representative of its position with regard to the guidance plant are received and processed to aid the steering of the drill head, said signals received from any or any combination of an electromagnetic field sensor offset from the centre of the drill head, relating to the distance from the guidance plant, an electromagnetic sensor mounted with its longitudinal axis on the longitudinal axis of the drill head, relating to the angular variation of the drill head relative to the guidance plant and a roll angle sensor mounted on the drill head with respect to the angular orientation with respect to a vertical plane.

29. A method according to claim 21, wherein said drill head includes an angled face and said advancing includes progressing said drill head along a required path as the drill head progresses, if deviation from the required path, or an obstacle, is detected, the drill is stopped rotating and, with the angled face in the correct orientation, the drill head is advanced with the angle face causing the same to move in the required direction to correct the deviation or create a new path direction.

30. A method according to claim 29 wherein, rather than react to a deviation or obstacle, the drill head is advanced to change the direction of the duct to be formed according to a predetermined plan.

* * * * *